US010982512B1

(12) United States Patent
Barker et al.

(10) Patent No.: US 10,982,512 B1
(45) Date of Patent: Apr. 20, 2021

(54) ASSESSING A DOWNHOLE STATE OF PERFORATING EXPLOSIVES

(71) Applicant: Halliburton Energy Services, Inc., Houston, TX (US)

(72) Inventors: James Marshall Barker, Mansfield, TX (US); Thomas Earl Burky, Mansfield, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/657,216

(22) Filed: Oct. 18, 2019

(51) Int. Cl.

| | |
|---|---|
| ***E21B 43/116*** | (2006.01) |
| ***E21B 47/06*** | (2012.01) |
| ***E21B 47/07*** | (2012.01) |
| *E21B 43/1185* | (2006.01) |

(52) U.S. Cl.
CPC ..... *E21B 43/116* (2013.01); *E21B 47/06* (2013.01); *E21B 47/07* (2020.05); *E21B 43/11855* (2013.01)

(58) Field of Classification Search
CPC ..... E21B 43/116; E21B 43/11855; E21B 43/11857; E21B 47/06; E21B 43/11
USPC ..... 175/4.54
See application file for complete search history.

(56) References Cited

U.S. PATENT DOCUMENTS

| | | | |
|---|---|---|---|
| 10,364,632 B2 | 7/2019 | Xu et al. | |
| 2007/0125540 A1 | 6/2007 | Gerez et al. | |
| 2012/0152542 A1 | 6/2012 | Le | |
| 2012/0155219 A1 | 6/2012 | Alteirac et al. | |
| 2015/0096752 A1 * | 4/2015 | Burgos | E21B 43/1185 166/297 |
| 2016/0237794 A1 | 8/2016 | Maxted et al. | |
| 2017/0032653 A1 * | 2/2017 | Crawford | E21B 43/1185 |
| 2018/0252091 A1 | 9/2018 | Bustos et al. | |

FOREIGN PATENT DOCUMENTS

| | | |
|---|---|---|
| EP | 2194227 A2 | 6/2010 |

OTHER PUBLICATIONS

Justine M. Davidson and James M. Barker, "Retrieval of Misfired Perforating Systems from Shallow Well Operations: Potential Thermal Cookoff Hazard," Society of Petroleum Engineers, 2015, SPE-174009-MS, 14 pages.

(Continued)

*Primary Examiner* — Taras P Bemko
(74) *Attorney, Agent, or Firm* — Haynes and Boone, LLP

(57) ABSTRACT

A wellbore perforating apparatus and method according to which a perforating gun and a sensor sub are run into a wellbore toward a downhole location at which the wellbore is to be perforated. Detonable components of the perforating gun are energized to perforate the wellbore at the downhole location. An acceleration of the perforating gun and a pressure and a temperature of the wellbore are detected using the sensor sub during a time interval encompassing the energization of the detonable components. The detected acceleration, pressure, and temperature are compared to benchmark energetic responses for both detonation and deflagration events. Based on this comparison, a decision can be made as to whether an incubation period is needed to allow a reaction of the detonable components to weaken before retrieving the perforating gun from the wellbore.

13 Claims, 6 Drawing Sheets

(56) References Cited

OTHER PUBLICATIONS

American Petroleum Institute, "Oilfield Explosives Safety," API Recommended Practice 76, Third Edition, Oct. 2019, 85 pages.
James M. Barker and John P. Davidson, "The Thermal Limit of an HMX Perforating System for Through-Tubing Gas Well Operations," Society of Petroleum Engineers, 2016, SPE-181416-MS, 15 pages.
International Search Report and Written Opinion from counterpart International Application No. PCT/US2019/057169, dated Jul. 13, 2020, ISA/KR, 11 pages.

* cited by examiner

ASSESSING A DOWNHOLE STATE OF PERFORATING EXPLOSIVES

TECHNICAL FIELD

The present disclosure relates generally to perforating wellbores, and, more particularly, to assessing a downhole state of perforating explosives both before and after firing in a wellbore.

BACKGROUND

Wellbores are typically drilled using a drill string with a drill bit secured to the lower free end and then, in the situation of cased-hole wells, completed by positioning a casing string within the wellbore and cementing the casing string in position. The casing increases the integrity of the wellbore and provides a flow path between the surface and a subterranean formation for: the injection of treating chemicals into the formation to stimulate production; receiving the flow of hydrocarbons from the formation; and permitting the introduction of fluids for reservoir management or disposal purposes. Perforating has conventionally been performed by lowering a perforating gun on a carrier string down a casing string within a wellbore. Once a desired wellbore depth is reached adjacent the target formation, the gun is secured and then fired. The gun may have one or many charges that are detonated using a firing control, which firing control may be activated from the surface via wireline or by hydraulic or mechanical means. Once the firing control is activated, the charge is detonated to perforate (penetrate) the casing, the cement, and, to a short distance, the formation. This establishes the desired fluid communication between the inside of the wellbore casing and the formation.

Typical perforating guns used in service operations for perforating a formation generally include explosive perforating charges mounted in a charge tube and ballistically connected together via explosive detonating cord. However, due to time-temperature limits of the explosive perforating charges and/or the detonating cord, that is, due to said components becoming degraded or unstable over time or at certain temperatures, incomplete firing of the perforating gun may occur when a firing attempt is made, presenting both performance and safety concerns.

DETAILED DESCRIPTION

The present disclosure introduces a wellbore perforating method to assess the downhole state of explosives in a perforating gun both before the perforating gun is fired, and/or after the perforating gun is fired but before the fired perforating gun is retrieved from the wellbore. To assess the state of the explosives in the perforating gun, whether unfired, partially-fired, or completely fired, the wellbore perforating method uses downhole measurements, such as, for example, pressure, acceleration, and temperature (i.e., wellbore conditions during conveyance downhole). The method yields a prediction of how the perforating gun is likely to perform downhole. Based on this prediction, a determination can be made as to whether the perforating trip should be continued or aborted (e.g., if for operational reasons the perforating gun is approaching time-temperature limits at which the explosives or other components of the perforating gun are less likely to function as desired). Moreover, if a firing attempt is made, the wellbore perforating method yields an assessment of whether the perforating gun underwent detonation (i.e., complete firing), strong deflagration, (i.e., partial firing), or weak deflagration (i.e., partial firing). This assessment may be used to determine what type of operational safety response should be planned when retrieving the perforating gun from the wellbore.

Figure 1:
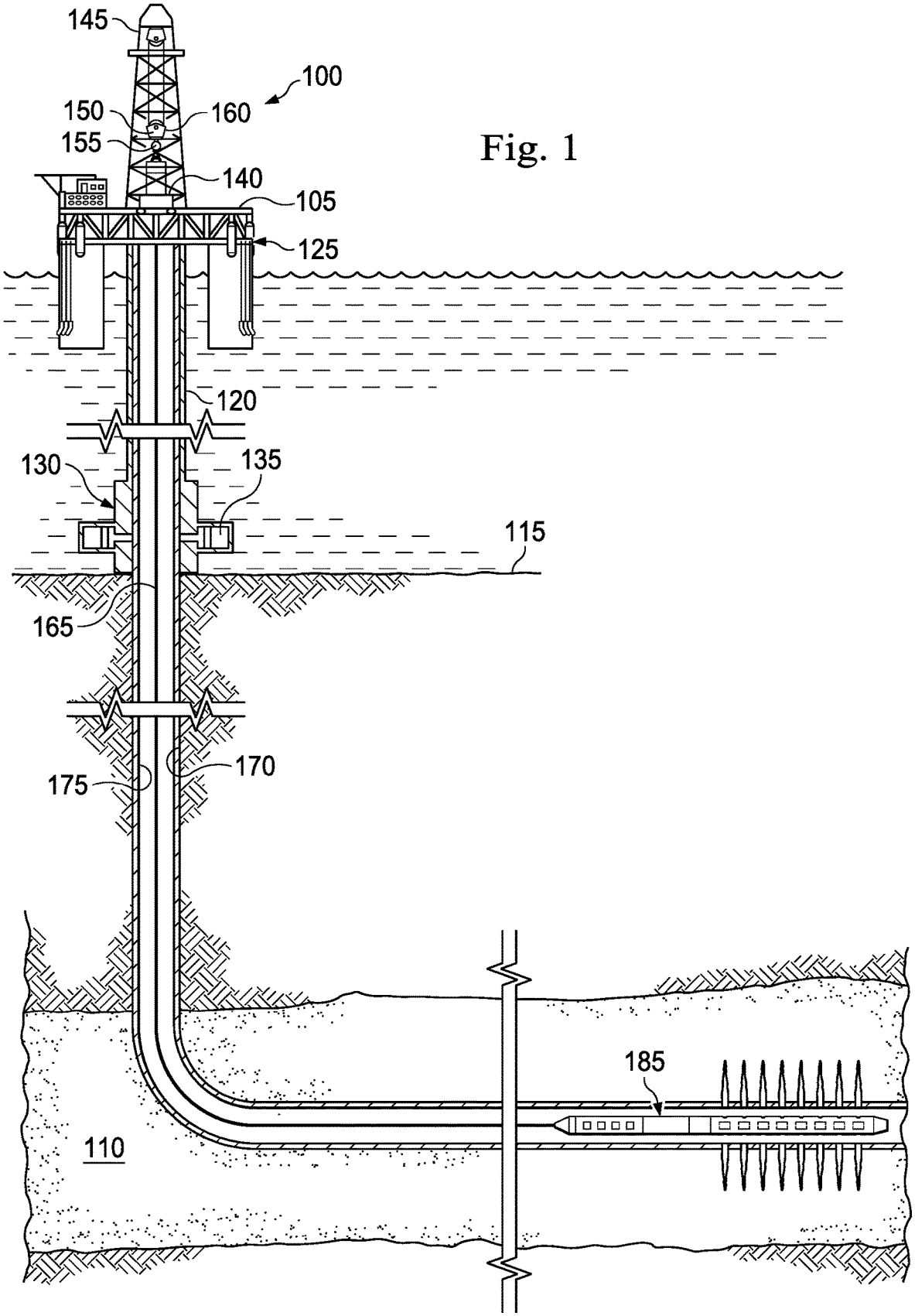
FIG. 1 is an illustration of an offshore oil and gas rig operably coupled to a subsurface wellbore perforating system, according to one or more embodiments of the present disclosure.

FIG. 1 is an illustration of an offshore oil and gas rig operably coupled to a subsurface wellbore perforating system, according to one or more embodiments of the present disclosure. Referring to FIG. 1, in an embodiment, the offshore oil and gas rig is generally referred to by the reference numeral 100. In an embodiment, the offshore oil and gas rig 100 includes a semi-submersible platform 105 that is positioned over a submerged oil and gas formation 110 located below a sea floor 115. A subsea conduit 120 extends from a deck 125 of the platform 105 to a subsea wellhead installation 130. One or more pressure control devices 135, such as, for example, blowout preventers (BOPs), and/or other equipment associated with drilling or producing a wellbore may be provided at the subsea wellhead installation 130 or elsewhere in the system. The platform 105 may also include a hoisting apparatus 140, a derrick 145, a travel block 150, a hook 155, and a swivel 160, which components are together operable for raising and lowering a conveyance string 165. The conveyance string 165 may be, include, or be part of, for example, a casing, a drill string, a completion string, a work string, a pipe joint, coiled tubing, production tubing, other types of pipe or tubing strings, and/or other types of conveyance strings, such as wireline, slickline, and/or the like. The platform 105 may also include a kelly, a rotary table, a top drive unit, and/or other equipment associated with the rotation and/or translation of the conveyance string 165.

A wellbore 170 extends from the subsea wellhead installation 130 and through the various earth strata, including the submerged oil and gas formation 110. In the situation of a cased-hole well, as in FIG. 1, at least a portion the wellbore 170 is completed by positioning a casing string 175 therein and securing the casing string 175 in position with cement 180 (shown in FIG. 2). The conveyance string 165 is, includes, or is operably coupled to a wellbore perforating system 185, which system is positioned within the wellbore 170 and adapted to perforate the casing string 175, the cement 180, and the wellbore 170 proximate the submerged oil and gas formation 110 so that fluid communication is established between the casing string 175 and the submerged oil and gas formation 110 surrounding the wellbore 170.

Figure 2:
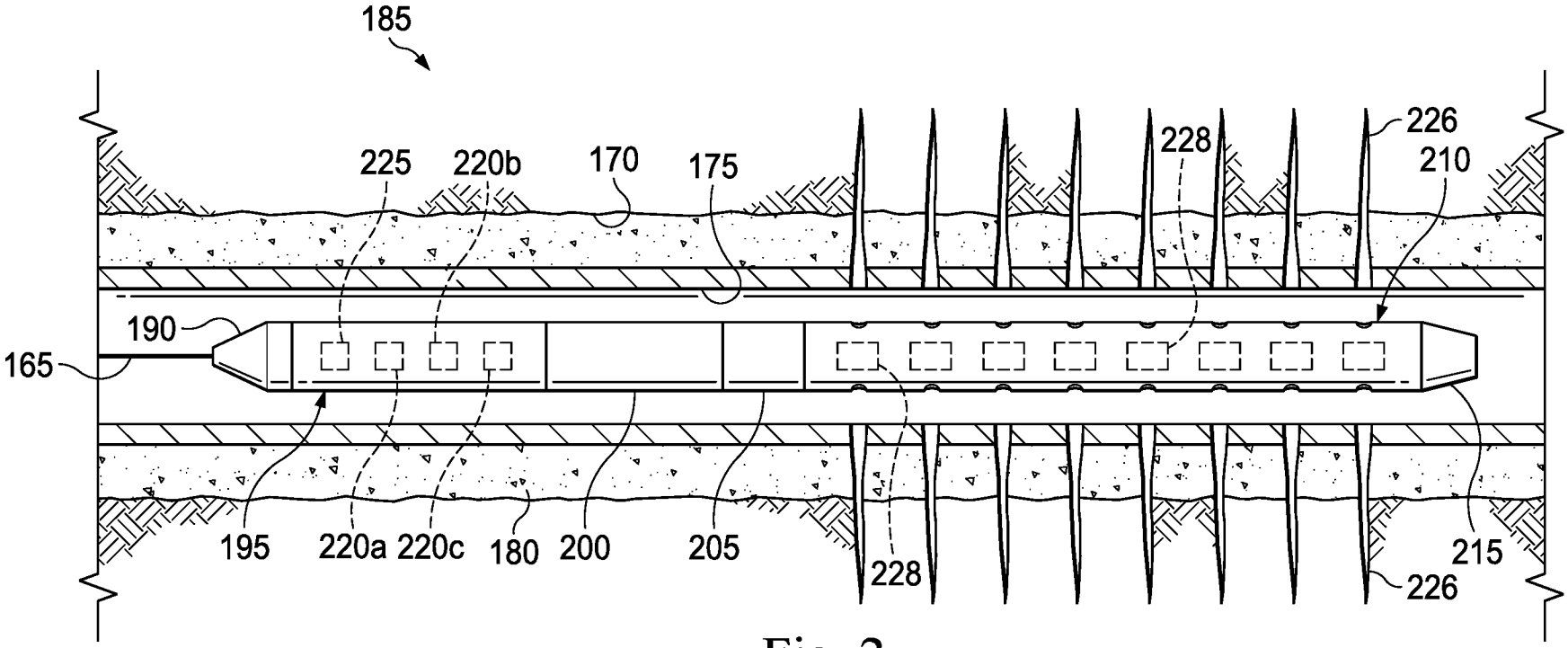
FIG. 2 is an enlarged elevational view of the wellbore perforating system of FIG. 1, according to one or more embodiments of the present disclosure.

FIG. 2 is an enlarged elevational view of the wellbore perforating system 185 of FIG. 1, according to one or more embodiments of the present disclosure. Referring to FIG. 2, with continuing reference to FIG. 1, in some embodiments, the wellbore perforating system 185 includes a cable head 190, a sensor sub 195, a casing collar location ("CCL") 200, a firing head 205, a perforating gun 210, and a bull plug 215. The cable head 190 is connected to a lower end of the conveyance string 165, which conveyance string, in this instance, is, includes, or is part of an electrical wireline or a tubing string equipped with electrical conductor(s). The cable head 190 is used to connect the sensor sub 195 to the conveyance string 165 in a manner that results in a good electrical path from the electrical conductor(s) of the conveyance string 165 to electrical contacts of the sensor sub 195 and shields this electrical path from contact with conductive fluids in the wellbore 170.

The sensor sub 195 is connected to the cable head 190 opposite the conveyance string 165 and includes a temperature sensor 220*a*, an accelerometer 220*b*, and a pressure sensor 220*c*. In some embodiments, as in FIG. 2, the sensor sub 195 also includes a controller 225 connected to, and adapted to receive data/signals from, the temperature sensor 220*a*, the accelerometer 220*b*, and the pressure sensor 220*c*. Although shown and described in FIG. 2 as being part of the sensor sub 195, in addition, or instead, the controller 225 may: be, include, or be part of another component of the wellbore perforating system 185 and adapted to communicate with the temperature sensor 220*a*, the accelerometer 220*b*, and the pressure sensor 220*c* via electrical conductor (s) of the wellbore perforating system 185 (or some other form of wired or wireless telemetry); be positioned at a location on the offshore oil and gas rig 100 outside of the wellbore 170, such as, for example, on the platform 105 (shown in FIG. 1) and adapted to communicate with the temperature sensor 220*a*, the accelerometer 220*b*, and the pressure sensor 220*c* via electrical conductor(s) of the conveyance string 165 (or some other form of wired or wireless telemetry); and/or be positioned remotely from the offshore oil and gas rig 100 and adapted to communicate wirelessly therewith. Moreover, although described as being connected to the cable head 190 opposite the conveyance string 165, the sensor sub 195 may instead be connected elsewhere in the wellbore perforating system 185.

The CCL 200 is connected to the sensor sub 195 opposite the cable head 190 and is used to ascertain a depth of the wellbore perforating system 185 in the wellbore 170 using known reference points on the casing string 175. Specifically, the CCL 200 is an electric logging tool configured to detect magnetic anomalies caused by the relatively high mass of casing collars in the casing string 175 to determine the depth of the wellbore perforating system 185 in the wellbore 170. Although described as being connected to the sensor sub 195 opposite the cable head 190, the CCL 200 may instead be connected elsewhere in the wellbore perforating system 185.

The firing head 205 is connected to the CCL 200 opposite the sensor sub 195 and is used to detonate the perforating gun 210. For example, if the firing head 205 is mechanical, may include a percussion detonator that is struck by a firing pin. For another example, if the firing head 205 is electronic, it may be battery powered to initiate an electric detonator. Although described as being connected to the CCL 200 opposite the sensor sub 195, the firing head 205 may instead be connected elsewhere in the wellbore perforating system 185.

The perforating gun 210 is connected to the firing head 205 opposite the CCL 200 and is operable to form perforations 226 through the casing string 175, the cement 180, and the wellbore 170 so that fluid communication is established between the casing string 175 and the submerged oil and gas formation 110 surrounding the wellbore 170 (shown in FIG. 1). More particularly, the perforating gun 210 includes detonable components 228 that are detonatable to form the perforations 226 through the casing string 175 and the cement 180. In some embodiments, the detonable components 228 of the perforating gun 210 are, include, or are part of a detonation train of the perforating gun 210, said detonation train including perforating charges, a detonating mechanism (e.g., detonating cord(s) or other explosives), and primers (e.g., explosive boosters) ballistically connecting the detonating mechanism to the perforating charges to facilitate detonation of the perforating charges. Although described as being connected to the firing head 205 opposite the CCL 200, the perforating gun 210 may instead be connected elsewhere in the wellbore perforating system 185.

The bull plug 215 is connected to the perforating gun 210 opposite the firing head 205 and is used as an isolation device before, during, or after the wellbore 170 is perforated using the perforating gun 210. In some embodiments, the bull plug 215 is a solid plug. Although described as being connected to the perforating gun 210 opposite the firing head 205, the bull plug 215 may instead be connected elsewhere in the wellbore perforating system 185.

In various embodiments, one or more components of the wellbore perforating system 185 described herein can be integrated with one or more other components of the wellbore perforating system 185. Accordingly, other wellbore perforating systems that do not include one or more components of the wellbore perforating system 185 described herein may nevertheless fall within the scope of the present disclosure.

Figure 3:
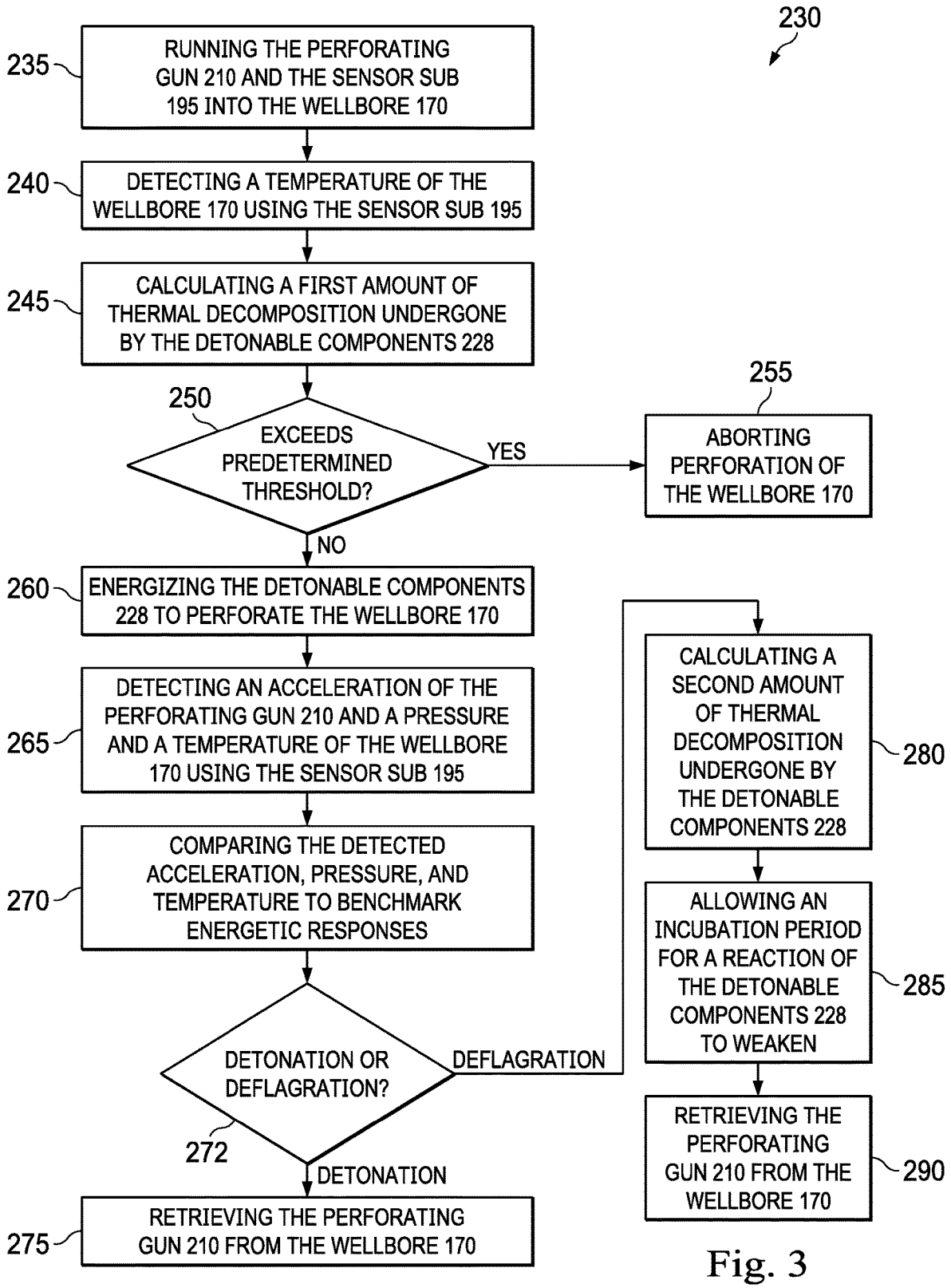
FIG. 3 is a flow diagram illustrating a method for assessing a downhole state of explosives in a perforating gun of the wellbore perforating system of FIGS. 1 and 2, according to one or more embodiments of the present disclosure.

FIG. 3 is a flow diagram illustrating a method for assessing a downhole state of explosives in a perforating gun of the wellbore perforating system of FIGS. 1 and 2, according to one or more embodiments of the present disclosure. Referring to FIG. 3, in some embodiments, the method to assess the downhole state of explosives in the perforating gun 210 is generally referred to by the reference numeral 230. At a step 235 of the method 230, the perforating gun 210 and the sensor sub 195 are run into the wellbore 170 toward a downhole location at which the wellbore 170 is to be perforated. At a step 240, a temperature of the wellbore 170 is detected using the sensor sub 195 as the perforating gun 210 is run into the wellbore 170. More particularly, temperature data/signals detected during the perforating gun 210's run into the wellbore 170 are communicated from the temperature sensor 220*a* of the sensor sub 195 to the controller 225. At a step 245, a first amount of thermal decomposition undergone by the detonable components 228 is calculated based on the detected temperature of the wellbore 170. The controller 225 may be used to calculate the first amount of thermal decomposition based on the detected temperature in the wellbore 170.

Figure 4:
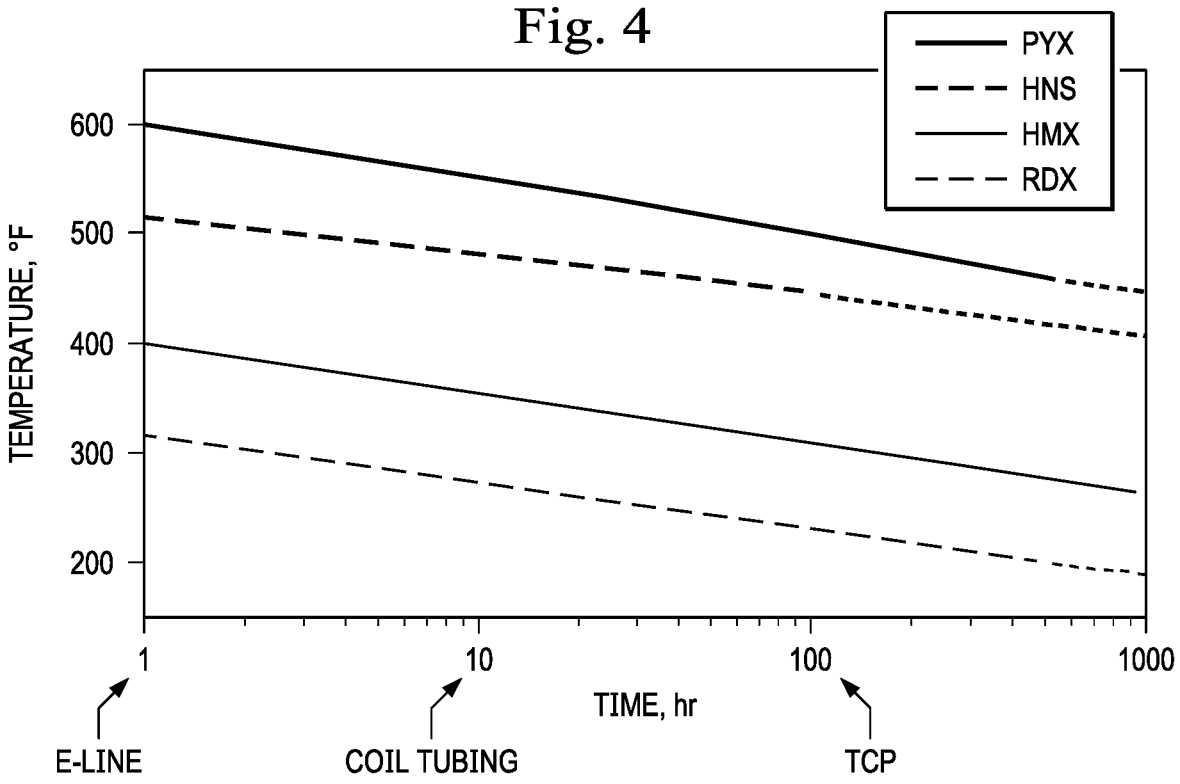
FIG. 4 is a time-temperature chart showing thermal decomposition rates for various types of detonable components, according to one or more embodiments of the present disclosure.

At a step 250, the calculated first amount of thermal decomposition of the perforating gun 210 is evaluated to determine if it exceeds a predetermined threshold. The controller 225 may be used to evaluate the calculated first amount of thermal decomposition of the perforating gun 210 to determine if it exceeds the predetermined threshold. In addition, or instead, the first amount of thermal decomposition calculated at the step 245 may be communicated to a surface location outside of the wellbore 170 so that an operator can manually evaluate the calculated first amount of thermal decomposition of the perforating gun 210 to determine if it exceeds the predetermined threshold. FIG. 4 is a time-temperature chart showing thermal decomposition rates for various types of detonable components, according to one or more embodiments of the present disclosure. More particularly, the predetermined threshold of the step 250 is shown by the various time-temperature curves in FIG. 4 and depends on the specific type of explosives used for the detonable components 228 of the perforating gun 210. For example, the explosives used for the detonable components 228 of the perforating gun 210 can be cyclotrimethylene trinitramine, RDX for short, and/or cyclotetramethylene tetranitramine, HMX for short. When conveyed by wireline, RDX is limited to exposure of 1 hour at 325° F. (163° C.), or, when tubing conveyed ("TCP"), to 100 hours at 235° F. (113° C.). Similarly, HMX survives 1 hour at 400° F. (204° C.) for wireline-conveyed applications and 100 hours at 310° F. (154° C.) for TCP applications. At higher temperatures or longer exposures, explosives are available to perforate reliably at up to 600° F. (316° C.) for wireline-conveyed applications and up to 500° F. (260° C.) for TCP. These high-temperature explosives, called HNS and PYX, are much more expensive and require specialty production, but result in a shift of their time-temperature curves above those for RDX and HMX (and a correspondingly higher predetermined threshold for the step 250), as shown in FIG. 4.

At a step 255, perforation of the wellbore 170 is aborted by retrieving the perforating gun 210 from the wellbore if the calculated first amount of thermal decomposition exceeds the predetermined threshold. In some embodiments, execution of the step 255 prevents, or at least reduces, safety issues associated with the retrieval of partially-fired detonable components 228 of the perforating gun 210 (i.e., strong deflagration or weak deflagration) from the wellbore 170. Such safety issues might otherwise arise on the deck 125 of the platform 105 in instances where detonation of the perforating gun 210 is attempted even though the time-temperature limits of the particular explosive employed have been exceeded. Moreover, the step 255 ensures that the detonable components 228 ultimately used in the perforating gun 210 to perforate the wellbore 170 are effective. At a step 260, the detonable components 228 are energized to perforate the wellbore 170 at the downhole location if the calculated first amount of thermal decomposition does not exceed the predetermined threshold. In some embodiments of the step 245, the first amount of thermal decomposition may be calculated at a plurality of depths within the wellbore 170. In such embodiments, the detonable components 228 may be energized at the step 260 to perforate the wellbore 170 at the downhole location if the calculated first amount of thermal decomposition does not exceed the predetermined threshold at any of the plurality of depths. At a step 265, an acceleration of the perforating gun 210 and a pressure and a temperature of the wellbore 170 are detected using the sensor sub 195 during a time interval encompassing the energization of the detonable components 228.

Figure 5:
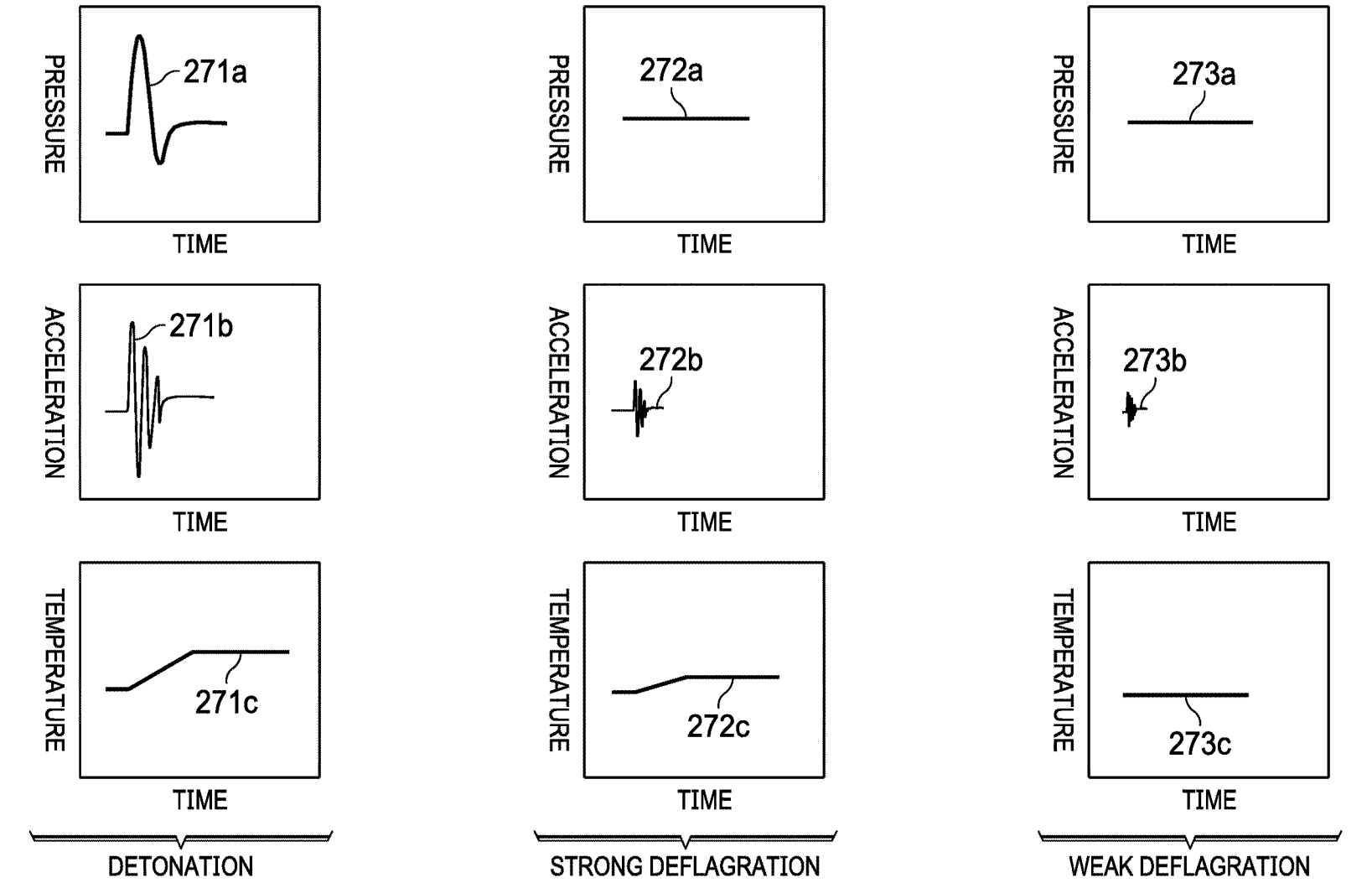
FIG. 5 is an illustration of charts of possible benchmark energetic responses for each of a detonation event, a strong deflagration event, and a weak deflagration event, according to one or more embodiments of the present disclosure.

At a step 270, the detected acceleration, pressure, and temperature are compared to benchmark energetic responses for both detonation and deflagration events. FIG. 5 is an illustration of charts of possible benchmark energetic responses for each of a detonation event, a strong deflagration event, and a weak deflagration event, according to one or more embodiments of the present disclosure. The benchmark energetic response for the detonation event includes: a pressure spike 271*a* (e.g., 11,000-13,000 psi); an acceleration spike 271*b* (e.g., several thousand g's); and a temperature increase 271*c* (e.g., 20-30° F.). The benchmark energetic response for the strong deflagration event includes: a pressure stagnation 272*a*; an acceleration spike 272*b*; and a temperature increase 272*c*. The acceleration spike 272*b* is relatively smaller than the acceleration spike 271*b*. The temperature increase 272*c* is relatively smaller than the temperature increase 271*c*. In some embodiments, the strong deflagration event may rupture the perforating gun so that, rather than the pressure stagnation 272*a*, the strong deflagration event includes a pressure spike (not shown) that is relatively smaller than the pressure spike 271*a*. The benchmark energetic response for the weak deflagration event includes: a pressure stagnation 273*a*; an acceleration spike 273*b*; and a temperature stagnation 273*c*. The acceleration spike 273*b* is relatively smaller than the acceleration spike 272*b*. The controller 225 may be used to compare the detected response to the benchmark energetic responses to yield a determination of whether detonation or deflagration (i.e., strong or weak) of the perforating gun 210 has occurred. At a step 272, a determination is made as to whether the comparison of the detected pressure, acceleration, and temperature of the wellbore 170 over time to benchmark energetic responses signifies the detonation or the deflagration event.

At a step 275, the perforating gun 210 is retrieved from the wellbore 170 if the comparison of the detected acceleration, pressure, and temperature to the benchmark energetic responses signifies that detonation of the detonable components 228 has occurred. At a step 280, a second amount of thermal decomposition undergone by the detonable components 228 is calculated if the comparison of the detected acceleration, pressure, and temperature to the benchmark energetic responses signifies that deflagration of the detonable components 228 has occurred. The controller 225 may be used to calculate the second amount of thermal decomposition of the perforating gun 210. At a step 285, an incubation period is allowed for a reaction of the detonable components 228 to weaken based on the calculated second amount of thermal decomposition. In some embodiments, execution of the step 285 prevents, or at least reduces, safety issues associated with the retrieval of partially-fired detonable components 228 of the perforating gun 210 (i.e., strong deflagration or weak deflagration) from the wellbore 170. Such safety issues might otherwise arise on the deck 125 of the platform 105 in instances where the perforating gun 210 is retrieved from the wellbore 170 even though an incubation period has not been allowed. Finally, at a step 290, the perforating gun 210 is retrieved from the wellbore 170 after the incubation period.

Advantageously, the operation of the perforating gun 210 and/or the execution of the method 230 can yield: an assessment of the downhole state of explosives in the perforating gun 210 before the perforating gun 210 is fired; a prediction of how the perforating gun 210 will perform downhole; an assessment of the downhole state of explosives in the perforating gun 210 after the perforating gun 210 is fired but before the fired perforating gun 210 is retrieved from the wellbore 170; and/or an assessment of whether the perforating gun underwent detonation (i.e., complete firing), strong deflagration, (i.e., partial firing), or weak deflagration (i.e., partial firing). As a result, the operation of the perforating gun 210 and/or the execution of the method 230 mitigates safety issues associated with the retrieval of partially-fired detonable components 228 of the perforating gun 210 (i.e., strong deflagration or weak deflagration) from the wellbore 170.

Figure 6:
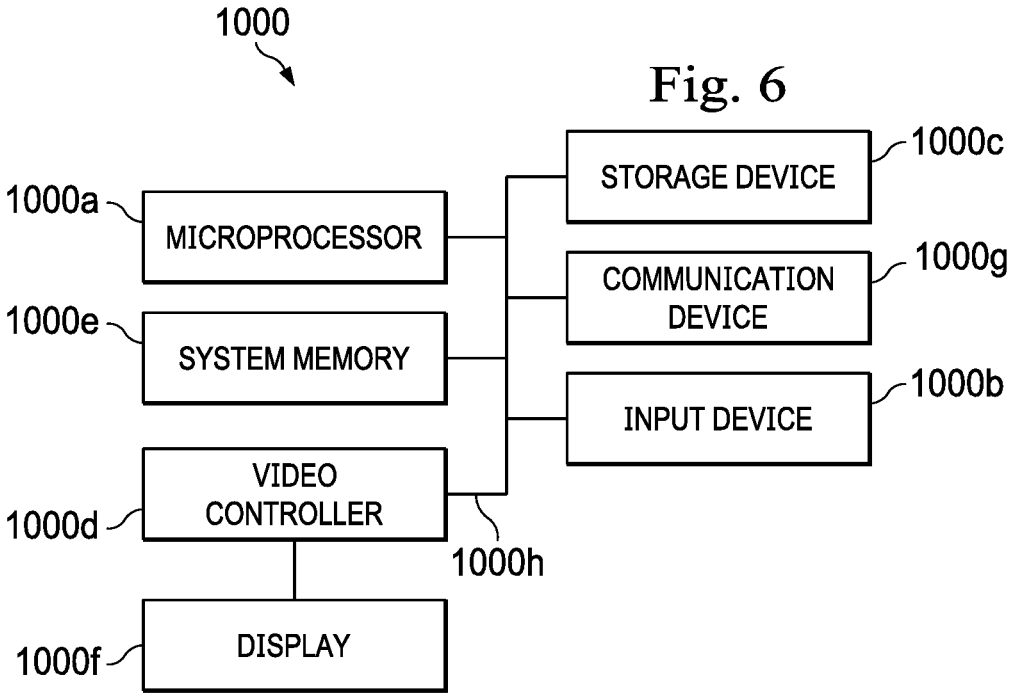
FIG. 6 is an illustration of a computing node for implementing one or more embodiments of the present disclosure.

FIG. 6 is an illustration of a computing node for implementing one or more embodiments of the present disclosure. More particularly, referring to FIG. 6, with continuing reference to FIGS. 1-5, in one or more embodiments, a computing node 1000 for implementing one or more embodiments of one or more of the above-described elements, systems (e.g., the wellbore perforating system 185), apparatus (e.g., the perforating gun 210), controllers (e.g., the controller 225), methods (e.g., the method 230), and/or steps (e.g., the steps 235, 240, 245, 250, 255, 260, 265, 270, 275, 280, 285, and/or 290), or any combination thereof, is depicted. The node 1000 includes a microprocessor 1000*a*, an input device 1000*b*, a storage device 1000*c*, a video controller 1000*d*, a system memory 1000*e*, a display 1000*f*, and a communication device 1000*g* all interconnected by one or more buses 1000*h*. In several embodiments, the microprocessor 1000*a* is, includes, or is part of, the controller 225. In several embodiments, the storage device 1000*c* may include a floppy drive, hard drive, CD-ROM, optical drive, any other form of storage device or any combination thereof. In several embodiments, the storage device 1000*c* may include, and/or be capable of receiving, a floppy disk, CD-ROM, DVD-ROM, or any other form of computer-readable medium that may contain executable instructions. In several embodiments, the communication device 1000*g* may include a modem, network card, or any other device to enable the node 1000 to communicate with other nodes. In several embodiments, any node represents a plurality of interconnected (whether by intranet or Internet) computer systems, including without limitation, personal computers, mainframes, PDAs, smartphones and cell phones.

In several embodiments, one or more of the components of any of the above-described systems include at least the node 1000 and/or components thereof, and/or one or more nodes that are substantially similar to the node 1000 and/or components thereof. In several embodiments, one or more of the above-described components of the node 1000 and/or the above-described systems include respective pluralities of same components.

In several embodiments, a computer system typically includes at least hardware capable of executing machine readable instructions, as well as the software for executing acts (typically machine-readable instructions) that produce a desired result. In several embodiments, a computer system may include hybrids of hardware and software, as well as computer sub-systems.

In several embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In several embodiments, hardware may include any physical device that is capable of storing machine-readable instructions, such as memory or other data storage devices. In several embodiments, other forms of hardware include hardware sub-systems, including transfer devices such as modems, modem cards, ports, and port cards, for example.

In several embodiments, software includes any machine code stored in any memory medium, such as RAM or ROM, and machine code stored on other devices (such as floppy disks, flash memory, or a CD ROM, for example). In several embodiments, software may include source or object code. In several embodiments, software encompasses any set of instructions capable of being executed on a node such as, for example, on a client machine or server.

In several embodiments, combinations of software and hardware could also be used for providing enhanced functionality and performance for certain embodiments of the present disclosure. In an embodiment, software functions may be directly manufactured into a silicon chip. Accordingly, combinations of hardware and software are also included within the definition of a computer system and are thus envisioned by the present disclosure as possible equivalent structures and equivalent methods.

In several embodiments, computer readable mediums include, for example, passive data storage, such as a random-access memory (RAM) as well as semi-permanent data storage such as a compact disk read only memory (CD-ROM). One or more embodiments of the present disclosure may be embodied in the RAM of a computer to transform a standard computer into a new specific computing machine. In several embodiments, data structures are defined organizations of data that may enable an embodiment of the present disclosure. In an embodiment, data structure may provide an organization of data, or an organization of executable code.

In several embodiments, any networks and/or one or more portions thereof, may be designed to work on any specific architecture. In an embodiment, one or more portions of any networks may be executed on a single computer, local area networks, client-server networks, wide area networks, internets, hand-held and other portable and wireless devices and networks.

In several embodiments, database may be any standard or proprietary database software. In several embodiments, the database may have fields, records, data, and other database elements that may be associated through database specific software. In several embodiments, data may be mapped. In several embodiments, mapping is the process of associating one data entry with another data entry. In an embodiment, the data contained in the location of a character file can be mapped to a field in a second table. In several embodiments, the physical location of the database is not limiting, and the database may be distributed. In an embodiment, the database may exist remotely from the server, and run on a separate platform. In an embodiment, the database may be accessible across the Internet. In several embodiments, more than one database may be implemented.

In several embodiments, a plurality of instructions stored on a computer readable medium may be executed by one or more processors to cause the one or more processors to carry out or implement in whole or in part the above-described operation of each of the above-described elements, systems (e.g., the wellbore perforating system 185), apparatus (e.g., the perforating gun 210), controllers (e.g., the controller 225), methods (e.g., the method 230), and/or steps (e.g., the steps 235, 240, 245, 250, 255, 260, 265, 270, 275, 280, 285, and/or 290), or any combination thereof. In several embodiments, such a processor may include one or more of the microprocessor 1000*a*, the controller 225, any processor(s) that are part of the components of the above-described systems, and/or any combination thereof, and such a computer readable medium may be distributed among one or more components of the above-described systems. In several embodiments, such a processor may execute the plurality of instructions in connection with a virtual computer system. In several embodiments, such a plurality of instructions may communicate directly with the one or more processors, and/or may interact with one or more operating systems, middleware, firmware, other applications, and/or any combination thereof, to cause the one or more processors to execute the instructions.

A wellbore perforating method has been disclosed according to a first aspect. The wellbore perforating method according to the first aspect generally includes running a perforating gun and a sensor sub into a wellbore toward a downhole location at which the wellbore is to be perforated; detecting a temperature of the wellbore using the sensor sub as the perforating gun and the sensor sub are run into the wellbore; calculating a first amount of thermal decomposition undergone by detonable components of the perforating gun based on the detected temperature of the wellbore; determining if the calculated first amount of thermal decomposition exceeds a predetermined threshold; and energizing the detonable components to perforate the wellbore at the downhole location if the calculated first amount of thermal decomposition does not exceed the predetermined threshold.

The foregoing wellbore perforating method embodiment may include one or more of the following elements, either alone or in combination with one another:

- the wellbore perforating method further comprises aborting perforation of the wellbore by retrieving the perforating gun from the wellbore if the calculated first amount of thermal decomposition exceeds the predetermined threshold;
- the first amount of thermal decomposition is calculated at a plurality of depths within the wellbore; and the detonable components are energized to perforate the wellbore at the downhole location if the calculated first amount of thermal decomposition does not exceed the predetermined threshold at any of the plurality of depths;
- the wellbore perforating method further comprises detecting an acceleration of the perforating gun and a pressure and a temperature of the wellbore using the sensor sub during a time interval encompassing the energization of the detonable components; and comparing the detected acceleration, pressure, and temperature to benchmark energetic responses for both detonation and deflagration events;
- the wellbore perforating method further comprises retrieving the perforating gun from the wellbore if the comparison of the detected acceleration, pressure, and temperature to the benchmark energetic responses signifies that detonation of the detonable components has occurred;
- the wellbore perforating method further comprises calculating a second amount of thermal decomposition undergone by the detonable components if the comparison of the detected acceleration, pressure, and temperature to the benchmark energetic responses signifies that deflagration of the detonable components has occurred;
- the wellbore perforating method further comprises allowing an incubation period for a reaction of the detonable components to weaken based on the calculated second amount of thermal decomposition; and retrieving the perforating gun from the wellbore after the incubation period.

A method has also been disclosed according to a second aspect. The method according to the second aspect generally includes running a perforating gun and a sensor sub into a wellbore toward a downhole location at which the wellbore is to be perforated; energizing detonable components of the perforating gun to perforate the wellbore at the downhole location; detecting an acceleration of the perforating gun and a pressure and a temperature of the wellbore using the sensor sub during a time interval encompassing the energization of the detonable components; comparing the detected acceleration, pressure, and temperature to benchmark energetic responses for both detonation and deflagration events; and retrieving the perforating gun from the wellbore if the comparison of the detected acceleration, pressure, and temperature to the benchmark energetic responses signifies that detonation of the detonable components has occurred.

The foregoing wellbore perforating method embodiment may include one or more of the following elements, either alone or in combination with one another:

- the wellbore perforating method further comprises calculating an amount of thermal decomposition undergone by the detonable components if the comparison of the detected acceleration, pressure, and temperature to the benchmark energetic responses signifies that deflagration of the detonable components has occurred;
- the wellbore perforating method further comprises allowing an incubation period for a reaction of the detonable components to weaken based on the calculated amount of thermal decomposition;
- the wellbore perforating method further comprises retrieving the perforating gun from the wellbore after the incubation period;
- the benchmark energetic responses comprise: a first benchmark energetic response for a detonation event; a second benchmark energetic response for a strong deflagration event; and a third benchmark energetic response for a weak deflagration event;
- the first benchmark energetic response for the detonation event includes: a first pressure spike; a first acceleration spike; and a first temperature increase;
- the second benchmark energetic response for the strong deflagration event includes: a first pressure stagnation or a second pressure spike; a second acceleration spike;
- and a second temperature increase; wherein the second pressure spike is relatively smaller than the first pressure spike; wherein the second acceleration spike is relatively smaller than the first acceleration spike; and wherein the second temperature increase is relatively smaller than the first temperature increase;
- the third benchmark energetic response for the weak deflagration event includes: a second pressure stagnation; a third acceleration spike; and a temperature stagnation; and wherein the third acceleration spike is relatively smaller than the second acceleration spike.

A wellbore perforating apparatus has also been disclosed according to a third aspect. The wellbore perforating apparatus according to the third aspect generally includes a non-transitory computer readable medium; and a plurality of instructions stored on the non-transitory computer readable medium and executable by one or more processors, the plurality of instructions comprising: instructions that, when executed, cause the one or more processors to detect, using a sensor sub, an acceleration of a perforating gun deployed within a wellbore and a pressure and a temperature of the wellbore during a time interval encompassing energization of detonable components of the perforating gun to perforate the wellbore at a downhole location; instructions that, when executed, cause the one or more processors to compare the detected acceleration, pressure, and temperature to benchmark energetic responses for both detonation and deflagration events; and instructions that, when executed, cause the one or more processors to prompt retrieval the perforating gun from the wellbore if the comparison of the detected acceleration, pressure, and temperature to the benchmark energetic responses signifies that detonation of the detonable components has occurred.

The foregoing wellbore perforating apparatus embodiment may include one or more of the following elements, either alone or in combination with one another:

the wellbore perforating apparatus further comprises instructions that, when executed, cause the one or more processors to calculate an amount of thermal decomposition undergone by the detonable components if the comparison of the detected acceleration, pressure, and temperature to the benchmark energetic responses signifies that deflagration of the detonable components has occurred;

the wellbore perforating apparatus further comprises instructions that, when executed, cause the one or more processors to prompt an incubation period for a reaction of the detonable components to weaken based on the calculated amount of thermal decomposition;

the wellbore perforating apparatus further comprises instructions that, when executed, cause the one or more processors to prompt retrieval of the perforating gun from the wellbore after the incubation period;

the benchmark energetic responses comprise: a first benchmark energetic response for a detonation event; a second benchmark energetic response for a strong deflagration event; and a third benchmark energetic response for a weak deflagration event.

It is understood that variations may be made in the foregoing without departing from the scope of the present disclosure.

In several embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

In several embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

What is claimed is:

1. A wellbore perforating method, comprising:

running a perforating gun and a sensor sub into a wellbore toward a downhole location at which the wellbore is to be perforated;

detecting a temperature of the wellbore using the sensor sub as the perforating gun and the sensor sub are run into the wellbore;

calculating a first amount of thermal decomposition undergone by detonable components of the perforating gun based on the detected temperature of the wellbore;

determining if the calculated first amount of thermal decomposition exceeds a predetermined threshold;

energizing the detonable components to perforate the wellbore at the downhole location if the calculated first amount of thermal decomposition does not exceed the predetermined threshold;

detecting an acceleration of the perforating gun and a pressure and a temperature of the wellbore using the sensor sub during a time interval encompassing the energization of the detonable components;

comparing the detected acceleration, pressure, and temperature to benchmark energetic responses for both detonation and deflagration events;

calculating a second amount of thermal decomposition undergone by the detonable components if the comparison of the detected acceleration, pressure, and temperature to the benchmark energetic responses signifies that deflagration of the detonable components has occurred;

allowing an incubation period for a reaction of the detonable components to weaken based on the calculated second amount of thermal decomposition; and retrieving the perforating gun from the wellbore after the incubation period.

2. The wellbore perforating method of claim 1, further comprising:

aborting perforation of the wellbore by retrieving the perforating gun from the wellbore if the calculated first amount of thermal decomposition exceeds the predetermined threshold.

3. The wellbore perforating method of claim 1, wherein the first amount of thermal decomposition is calculated at a plurality of depths within the wellbore; and wherein the detonable components are energized to perforate the wellbore at the downhole location if the calculated first amount of thermal decomposition does not exceed the predetermined threshold at any of the plurality of depths.

4. The wellbore perforating method of claim 1, further comprising:

retrieving the perforating gun from the wellbore if the comparison of the detected acceleration, pressure, and temperature to the benchmark energetic responses signifies that detonation of the detonable components has occurred.

5. A wellbore perforating method, comprising:

running a perforating gun and a sensor sub into a wellbore toward a downhole location at which the wellbore is to be perforated;

energizing detonable components of the perforating gun to perforate the wellbore at the downhole location;

detecting an acceleration of the perforating gun and a pressure and a temperature of the wellbore using the sensor sub during a time interval encompassing the energization of the detonable components;

comparing the detected acceleration, pressure, and temperature to benchmark energetic responses for both detonation and deflagration events;

retrieving the perforating gun from the wellbore if the comparison of the detected acceleration, pressure, and temperature to the benchmark energetic responses signifies that detonation of the detonable components has occurred;

calculating a thermal decomposition undergone by the detonable components if the comparison of the detected acceleration, pressure, and temperature to the benchmark energetic responses signifies that deflagration of the detonable components has occurred; and allowing an incubation period for a reaction of the detonable components to weaken based on the calculated thermal decomposition.

6. The wellbore perforating method of claim 5, further comprising: retrieving the perforating gun from the wellbore after the incubation period.

7. A wellbore perforating method, comprising:

running a perforating gun and a sensor sub into a wellbore toward a downhole location at which the wellbore is to be perforated;

energizing detonable components of the perforating gun to perforate the wellbore at the downhole location;

detecting an acceleration of the perforating gun and a pressure and a temperature of the wellbore using the sensor sub during a time interval encompassing the energization of the detonable components;

comparing the detected acceleration, pressure, and temperature to benchmark energetic responses for both detonation and deflagration events; and retrieving the perforating gun from the wellbore if the comparison of the detected acceleration, pressure, and temperature to the benchmark energetic responses signifies that detonation of the detonable components has occurred;

wherein the benchmark energetic responses comprise:

a first benchmark energetic response for a detonation event;

a second benchmark energetic response for a strong deflagration event; and a third benchmark energetic response for a weak deflagration event.

8. The wellbore perforating method of claim 7, wherein the first benchmark energetic response for the detonation event includes:

a first pressure spike;

a first acceleration spike; and a first temperature increase.

9. The wellbore perforating method of claim 8, wherein the second benchmark energetic response for the strong deflagration event includes:

a first pressure stagnation or a second pressure spike;

a second acceleration spike; and a second temperature increase;

wherein the second pressure spike is relatively smaller than the first pressure spike;

wherein the second acceleration spike is relatively smaller than the first acceleration spike; and wherein the second temperature increase is relatively smaller than the first temperature increase.

10. The wellbore perforating method of claim 9, wherein the third benchmark energetic response for the weak deflagration event includes:

a second pressure stagnation;

a third acceleration spike; and a temperature stagnation; and wherein the third acceleration spike is relatively smaller than the second acceleration spike.

11. A wellbore perforating apparatus, comprising:

a non-transitory computer readable medium; and a plurality of instructions stored on the non-transitory computer readable medium and executable by one or more processors, the plurality of instructions comprising:

instructions that, when executed, cause the one or more processors to detect, using a sensor sub, an acceleration of a perforating gun deployed within a wellbore and a pressure and a temperature of the wellbore during a time interval encompassing energization of detonable components of the perforating gun to perforate the wellbore at a downhole location;

instructions that, when executed, cause the one or more processors to compare the detected acceleration, pressure, and temperature to benchmark energetic responses for both detonation and deflagration events;

instructions that, when executed, cause the one or more processors to prompt retrieval the perforating gun from the wellbore if the comparison of the detected acceleration, pressure, and temperature to the benchmark energetic responses signifies that detonation of the detonable components has occurred;

instructions that, when executed, cause the one or more processors to calculate an amount of thermal decomposition undergone by the detonable components if the comparison of the detected acceleration, pressure, and temperature to the benchmark energetic responses signifies that deflagration of the detonable components has occurred; and instructions that, when executed, cause the one or more processors to prompt an incubation period for a reaction of the detonable components to weaken based on the calculated amount of thermal decomposition.

12. The wellbore perforating apparatus of claim 11, further comprising:

instructions that, when executed, cause the one or more processors to prompt retrieval of the perforating gun from the wellbore after the incubation period.

13. A wellbore perforating apparatus, comprising:

a non-transitory computer readable medium; and a plurality of instructions stored on the non-transitory computer readable medium and executable by one or more processors, the plurality of instructions comprising:

instructions that, when executed, cause the one or more processors to detect, using a sensor sub, an acceleration of a perforating gun deployed within a wellbore and a pressure and a temperature of the wellbore during a time interval encompassing energization of detonable components of the perforating gun to perforate the wellbore at a downhole location;

instructions that, when executed, cause the one or more processors to compare the detected acceleration, pressure, and temperature to benchmark energetic responses for both detonation and deflagration events; and instructions that, when executed, cause the one or more processors to prompt retrieval the perforating gun from the wellbore if the comparison of the detected acceleration, pressure, and temperature to the benchmark energetic responses signifies that detonation of the detonable components has occurred;

wherein the benchmark energetic responses comprise:

a first benchmark energetic response for a detonation event;

a second benchmark energetic response for a strong deflagration event; and a third benchmark energetic response for a weak deflagration event.

* * * * *